US006400921B1

(12) United States Patent
Leclerc et al.

(10) Patent No.: US 6,400,921 B1
(45) Date of Patent: Jun. 4, 2002

(54) EDGE ENHANCEMENT SCAVENGING DEVICE

(75) Inventors: Gerald Scott Leclerc, Webster; Richard M. Maier, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/843,481

(22) Filed: Apr. 26, 2001

(51) Int. Cl.[7] ..... G03G 15/08
(52) U.S. Cl. ..... 399/266; 399/296
(58) Field of Search ..... 399/266, 290, 399/292, 293, 296

(56) References Cited

U.S. PATENT DOCUMENTS 4,701,042 A * 10/1987 Mimura et al. ..... 399/296

* cited by examiner

*Primary Examiner*—Quana M. Grainger
(74) *Attorney, Agent, or Firm*—Lloyd F. Bean, II

(57) ABSTRACT

An apparatus for developing a latent electrostatic image on a charge retentive surface moving in a process direction with toner, the apparatus comprising: a supply of toner; a donor structure spaced from the charge retentive surface for conveying toner from the supply of toner to an area adjacent the charge retentive surface, a device for applying an alternating current directly to the donor structure to create an alternating electrostatic field between the donor structure and said charge retentive surface to produce a toner cloud adjacent the charge retentive surface for developing the latent electrostatic image thereon; and an edge enhancement device, adjacent to the donor structure, for redistributing toner on the developed latent electrostatic image.

10 Claims, 6 Drawing Sheets

EDGE ENHANCEMENT SCAVENGING DEVICE

BACKGROUND AND SUMMARY

Cross reference is made to the following applications filed concurrently herewith: entitled "TC Runtime Control Using Underdeveloped Solid, and Edge Enhancement" and entitled "Dynamic Duty Cycle For Increased Latitude".

This invention relates generally to a hybrid jumping developer system, and more particularly concerns a scavenging device for such a system for improving edge enhancement of the develop image.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In a machine of the foregoing type, utilizing a hybrid jumping development (HJD) system, the development roll, better known as the donor roll, is powered by two development fields (potentials across an air gap). The first field is the ac jumping field which is used for toner cloud generation and has a typical potential of 2.25 k volts peak to peak at 3.25 kHz frequency. The second field is the dc development field which is used to control the amount of developed toner mass on the photoreceptor.

SUMMARY OF THE INVENTION

There is provided an apparatus for developing a latent electrostatic image on a charge retentive surface moving in a process direction with toner, said apparatus comprising: a supply of toner; a donor structure spaced from said charge retentive surface for conveying toner from said supply of toner to an area adjacent said charge retentive surface, a device for applying an alternating current directly to said donor structure to create an alternating electrostatic field between said donor structure and said charge retentive surface to produce a toner cloud adjacent said charge retentive surface for developing the latent electrostatic image thereon; and an edge enhancement device, adjacent to said donor structure, for redistributing toner on the developed latent electrostatic image.

DRAWING DESCRIPTION

Other features of the present invention will become apparent as the following description proceeds and upon reference to the drawings, in which.

Figure 3:
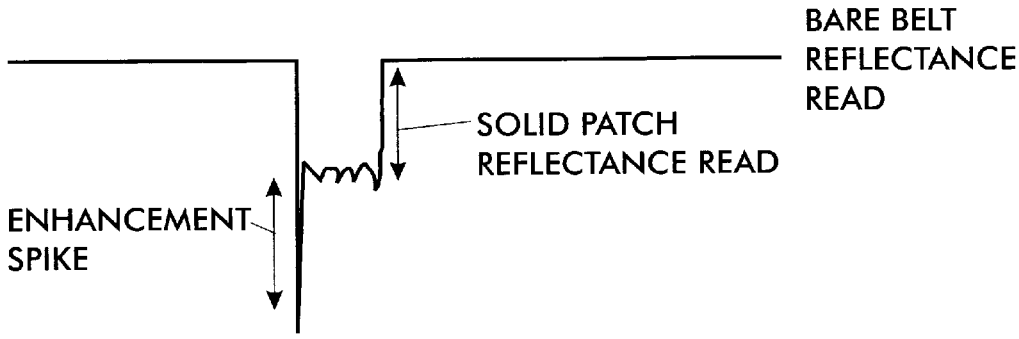

The edge portion enhancement appears as a spike in FIG. 3.

Figure 4:
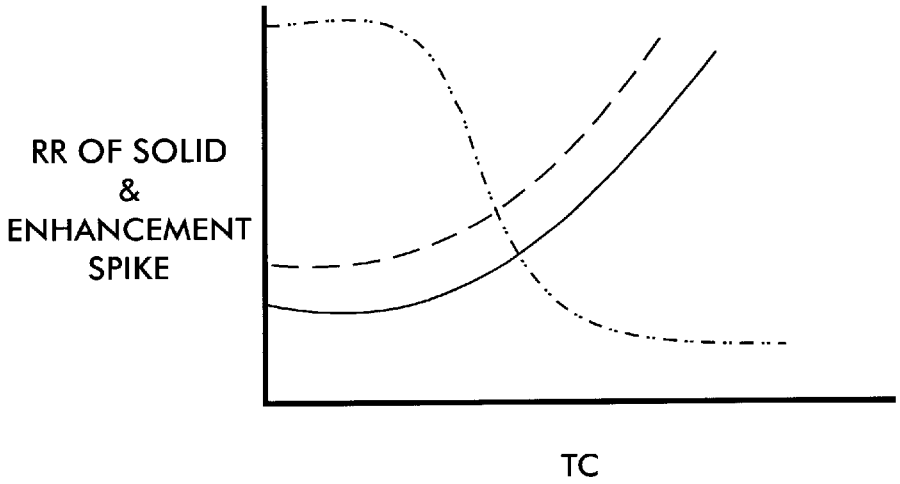

FIG. 4 shows underdeveloped solids vs. TC and enhancement spike vs. TC.

FIG. 4 is a diagram showing the relative biases on magnetic roll 38 and donor roll 36 for a typical practical embodiment of a xerographic printer.

Figure 6:
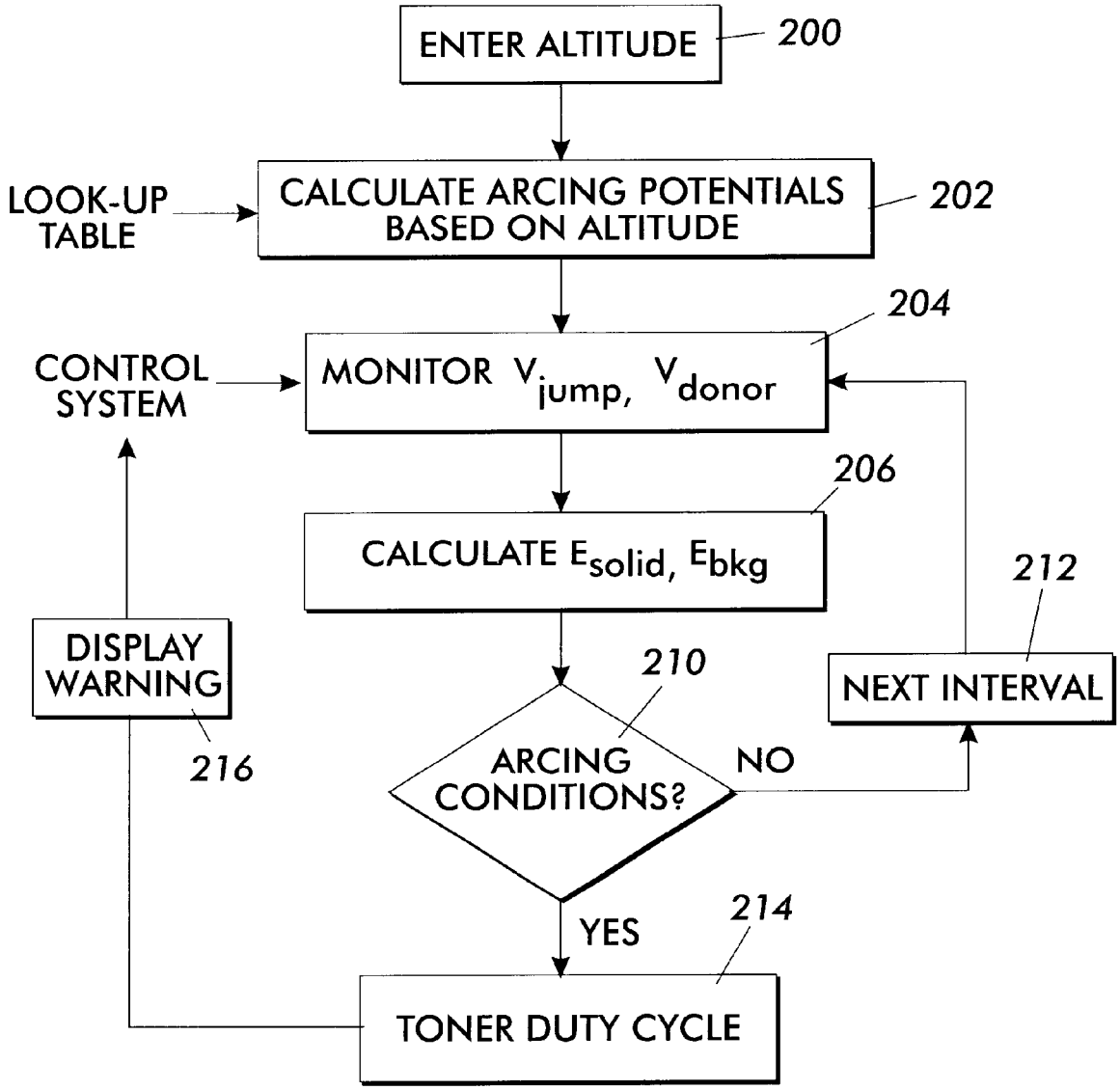

FIG. 6 is a flowchart illustrating the arcing-control aspect of a control system for a xerographic printer according to the present invention.

Figure 7:
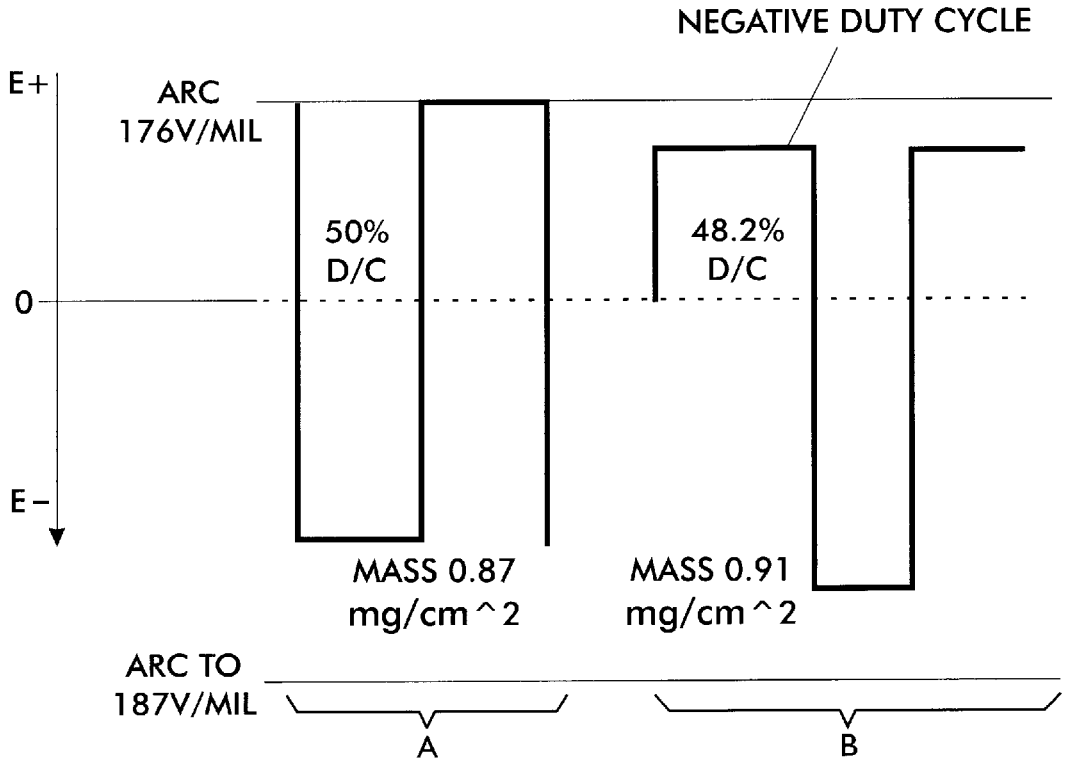

FIG. 7 illustrates a typical HJD system with 50% duty cycle.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims. For a general understanding of the features of the present invention, reference is made to the drawings. In the drawings, like reference numerals have been used throughout to identify identical elements.

Figure 1:
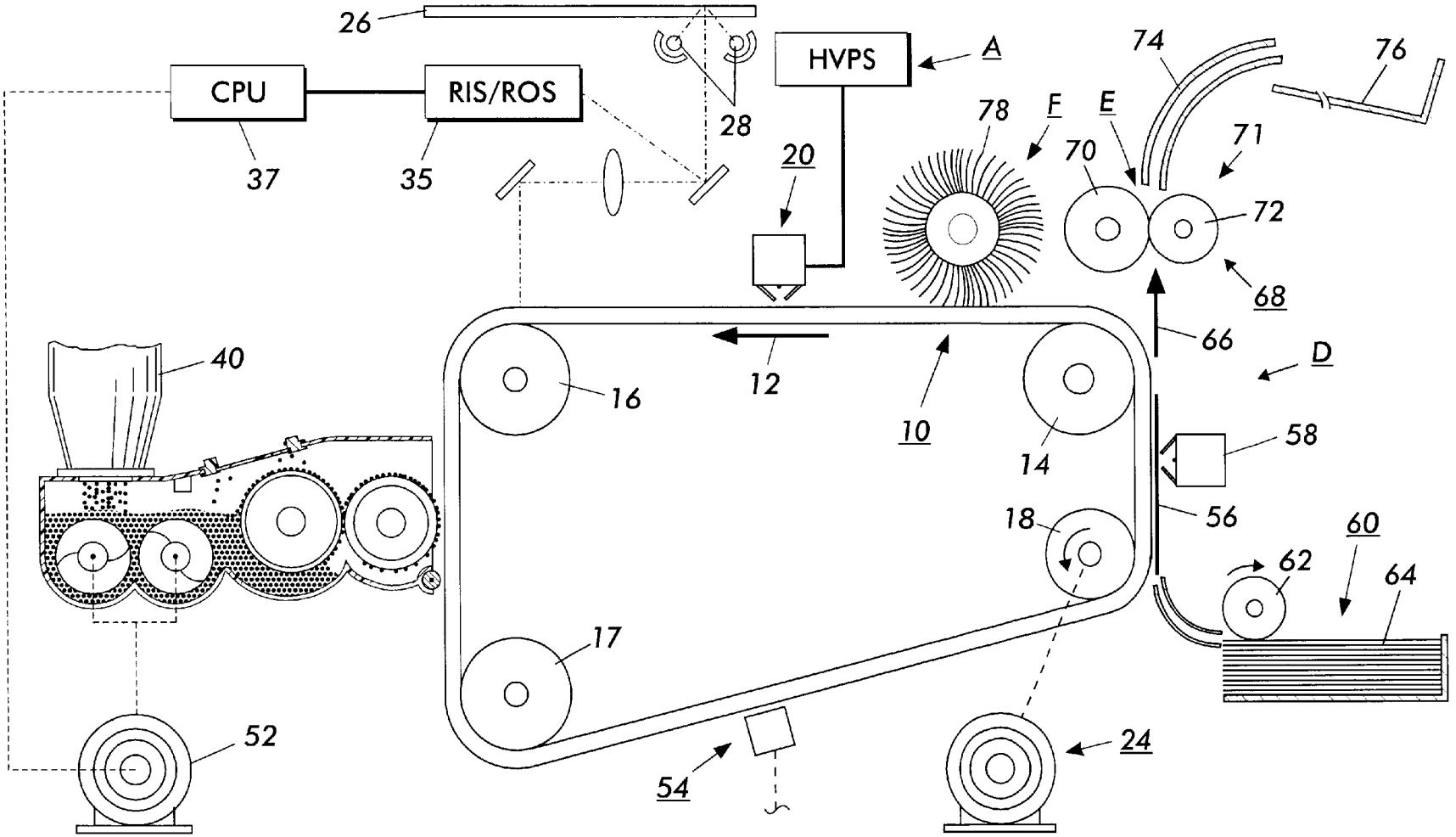
FIG. 1 is a schematic elevational view of a typical electrophotographic printing machine utilizing the toner maintenance system therein.

FIG. 1 schematically depicts an electrophotographic printing machine incorporating the features of the present invention therein. It will become evident from the following discussion that the development system of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 12 to advance successive portions sequentially through the various processing stations disposed about the path of movement thereof. Belt 10 is entrained about stripping roller 14, tensioning rollers 16 and 17 and drive roller 18. As roller 18 rotates, it advances belt 10 in the direction of arrow 12. Initially, a portion of the photoconductive surface passes through charging station A.

At charging station A, a corona generating device indicated generally by the reference numeral 20 charges the photoconductive belt 10 to a relatively high, substantially uniform potential. At exposure station B, a controller or electronic subsystem (ESS) or CPU 37, indicated generally by reference numeral 37, receives the image signals representing the desired output image and processes these signals to convert them to a continuous tone or grayscale rendition of the image which is transmitted to a modulated output generator, for example, the raster output scanner (ROS), indicated generally by reference numeral 35. Preferably, CPU 37 is a self-contained, dedicated minicomputer.

The image signals transmitted to CPU 37 may originate from a RIS as described above or from a computer, thereby enabling the electrophotographic printing machine to serve as a remotely located printer for one or more computers. Alternatively, the printer may serve as a dedicated printer for a high-speed computer. The signals from CPU 37, corresponding to the continuous tone image desired to be reproduced by the printing machine, are transmitted to ROS 35. ROS 35 includes a laser with rotating polygon mirror blocks. The ROS 35 will expose the photoconductive belt to record an electrostatic latent image thereon corresponding to the continuous tone image received from CPU 37. As an alternative, ROS 35 may employ a linear array of light emitting diodes (LEDs) arranged to illuminate the charged portion of photoconductive belt 10 on a raster-by-raster basis. The CPU counts the number of dark pixels and light pixels to determine the average amount of toner particles required to develop the latent image.

The CPU processes these signals in a suitable circuit and generates an output signal used to anticipate the amount of toner particles required to form a copy of the original document. This output signal controls the dispensing of toner particles into the developer housing. The anticipatory dispensing system is an open loop system which converts the measure of the original area coverage into the amount of toner required. An open loop system of this type can gradually increase or decrease the toner particle concentration within the developer material. This is due to developability varying according to environmental and operator selections in addition to document average coverage requirements. To prevent this from occurring, a closed loop system may be employed in conjunction with the open loop anticipatory system. This is accomplished by having imaging station B include a test area generator mode in which the ROS writes a test patch onto the charged portion of photoconductive belt 10, in the inter-image region, i.e. between successive electrostatic latent images recorded on photoconductive belt 10. The test patch recorded on photoconductive belt 10 is a square approximately 5 centimeters by 5 centimeters. The present invention employs a record test patch of a continuous tone or under developed solid which is generated by having (low mag and Donor DC) (65 Vdm, 0 V donor).

The electrostatic latent image and test patch are then developed with toner particles at development station C. In this way, a toner powder image and a developed test patch is formed on photoconductive belt 10. Development of the test patch results in a continuous tone portion and an edge portion. The developed test patch is subsequently examined to determine the quality of the toner image being developed on the photoconductive belt.

After the electrostatic latent image has been recorded on photoconductive surface of belt 10 advances the latent image to development station C where toner, in the form of dry particles, is electrostatically attracted to the latent image using the device of the present invention as further described below. The latent image attracts toner particles from the carrier granules forming a toner powder image thereon. As successive electrostatic latent images are developed, toner particles are depleted from the developer material. A toner particle dispenser, indicated generally by the reference numeral 40, on signal from CPU 37, dispenses toner particles into developer housing 42 of developer unit 34 based on signals from a toner maintenance sensor (not shown).

Densitometer 54, positioned adjacent the photoconductive belt between developer station C and transfer station D, generates electrical signals proportional to the developed test patch. These signals are conveyed to a control system and suitably processed for regulating the processing stations of the printing machine. Preferably, densitometer 54 is an infrared densitometer. The infrared densitometer is energized at 15 volts DC and about 50 milliamps. The surface of the infrared densitometer is about 7 millimeters from the surface of photoconductive belt 10. Densitometer 54 includes a semiconductor light emitting diode having a 940 nanometer peak output wavelength with a 60 nanometer one-half power bandwidth. The power output is approximately 45 milliwatts. A photodiode receives the light rays reflected from the developed test patch and converts the measured light ray input to an electrical output signal. The infrared densitometer is also used to periodically measure the light rays reflected from the bare photoconductive surface, i.e. without developed toner particles, to provide a reference level for calculation of the signal ratio. A densitometer 54 measures the density of the developed test patch continuous tone portion and edge portion and transmits a signal to CPU 37. CPU 37 controls the dispensing of toner particles in response to the signal from the densitometer and from the scanner. Representative measurements are shown in FIGS. 3 and 4. Applicants have found when all the development voltages constant, the only significant noise to DMA is TC/tribo. Therefore, any change in DMA should be caused by TC. A feature of the present invention is to examine the underdeveloped solid (which correlates to DMA) to determined if the TC/Tribo has shifted from the ideal value. The densitometer measures the density of the underdeveloped solid portion of the patch and measures the edge portion enhancement of the patch which is caused by the ballistics of the toner in the development nip. The difference in the density between the enhancement and the underdeveloped solid portion to the developability of the developer system, and thus the TC the patch was run at. The edge portion enhancement appears as a spike in FIG. 3. FIG. 4 shows underdeveloped solids vs. TC and enhancement spike vs. TC.

With continued reference to FIG. 1, after the electrostatic latent image is developed, the toner powder image present on belt 10 advances to transfer station D. A print sheet 66 is advanced to the transfer station D by a sheet feeding apparatus, 60. Preferably, sheet feeding apparatus 60 includes a feed roll 62 contacting the uppermost sheet of stack 64. Feed roll 62 rotates to advance the uppermost sheet from stack 64 into vertical transport 56. Vertical transport 56 directs the advancing sheet 66 of support material into registration transport past image transfer station D to receive an image from photoreceptor belt 10 in a timed sequence so that the toner powder image formed thereon contacts the advancing sheet 66 at transfer station D. Transfer station D includes a corona generating device 58 which sprays ions onto the back side of sheet 48. This attracts the toner powder image from photoconductive surface 12 to sheet 66. After transfer, sheet 66 continues to move to fusing station F.

Fusing station F includes a fuser assembly indicated generally by the reference numeral 71 which permanently affixes the transferred toner powder image to the copy sheet. Preferably, fuser assembly includes a heated fuser roller 70 and a pressure roller 72 with the powder image on the copy sheet contacting fuser roller 72. The sheet then passes through fuser 71 where the image is permanently fixed or fused to the sheet. After passing through fuser 70, the sheet to move directly via output 74 to an output tray 76. After the print sheet is separated from photoconductive surface 12 of belt 10, the residual toner/developer and paper fiber particles adhering to photoconductive surface are removed therefrom at cleaning station E.

Cleaning station E includes a rotatably mounted fibrous brush 78 in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by CPU 37. The controller is preferably a programmable microprocessor which controls all of the machine functions hereinbefore described including toner dispensing. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
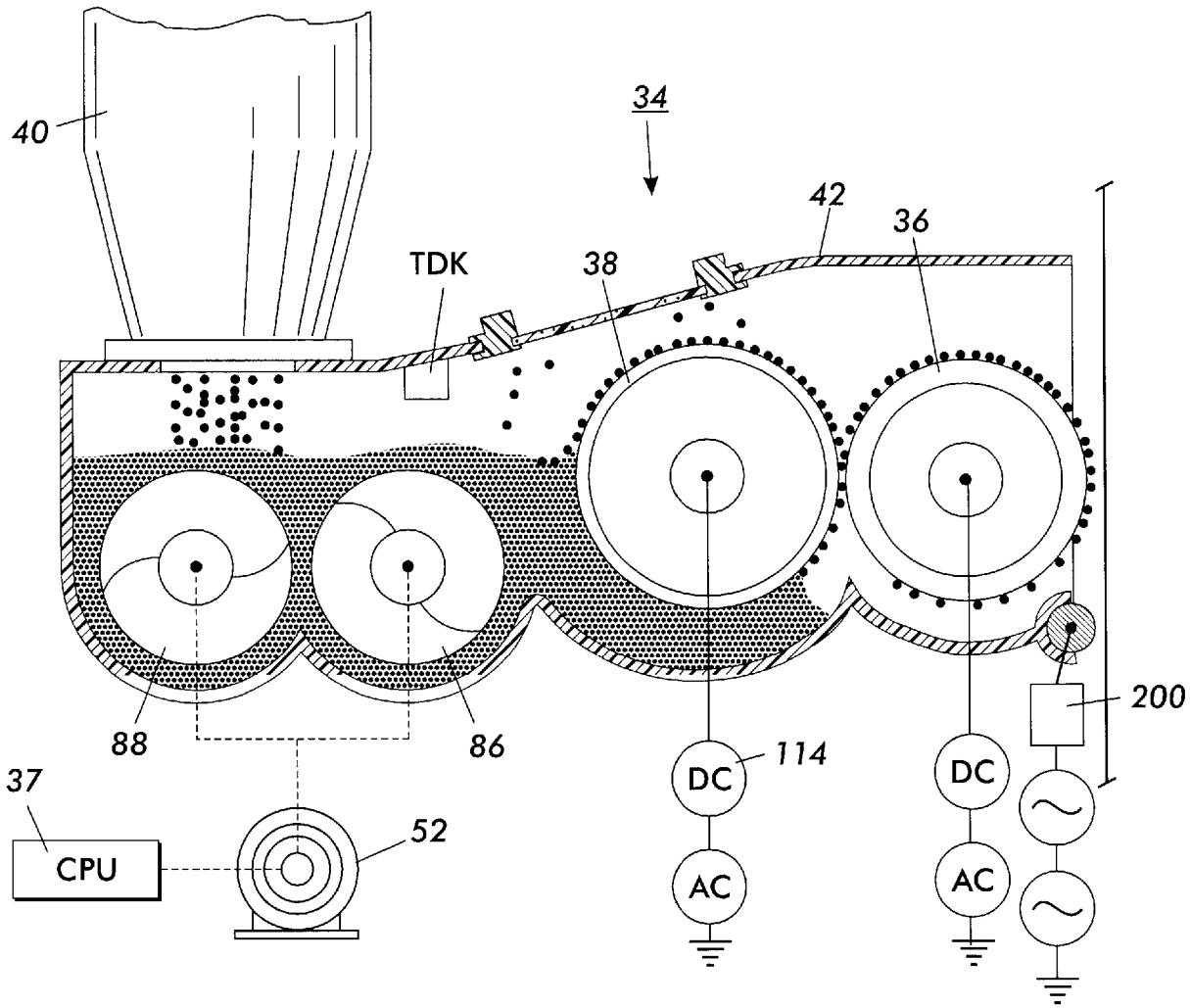
FIG. 2 is a schematic elevational view of the development system utilizing the invention herein.

Turning now to FIG. 2, development system 34 is shown in greater detail. (More specifically a hybrid development system is shown where toner is loaded onto a donor roll from a second roll (e.g. a magnetic brush roll)). The toner is developed onto the photoreceptor from the donor roll using the hybrid jumping development system (HJD) described below. As shown thereat, development system 34 includes a housing 42 defining a chamber for storing a supply of developer material therein. Donor roller 36 and magnetic roller 38 are mounted in chamber of housing 42. The donor roller 26 can be rotated in either the 'with' or 'against' direction relative to the direction of motion of the photoreceptor 10.

In FIG. 2, donor roller 36 is shown rotating in the direction of arrow, i.e. the against direction. Similarly, the magnetic roller 38 can be rotated in either the 'with' or 'against' direction relative to the direction of motion of donor roller 36. In FIG. 2, magnetic roller 38 is shown rotating in the direction of arrow i.e. the 'with' direction.

Donor roller 36 is preferably made from a conductive core which may be a metallic material with a semi-conductive coating such as a phenolic thereon. Magnetic roller 38 meters a constant quantity of toner having a substantially constant charge onto donor roller 36. This ensures that the donor roller provides a constant amount of toner having a substantially constant charge as maintained by the present invention in the development gap.

A DC bias supply 184 which applies approximately 100 volts to magnetic roller 38 establishes an electrostatic field between magnetic roller 38 and donor roller 36 so that an electrostatic field is established between the donor roller 36 and the magnetic roller 38 which causes toner particles to be attracted from the magnetic roller 38 to the donor roller 36. Metering blade (not shown) is positioned closely adjacent to magnetic roller 38 to maintain the compressed pile height of the developer material on magnetic roller 38 at the desired level. Magnetic roller 38 includes a non-magnetic tubular member made preferably from aluminum and having the exterior circumferential surface thereof roughened. An elongated magnet is positioned interiorly of and spaced from the tubular member. The magnet is mounted stationarily. The tubular member rotates in the direction of arrow to advance the developer material adhering thereto into the nip defined by donor roller 36 and magnetic roller 38.

Figure 5:
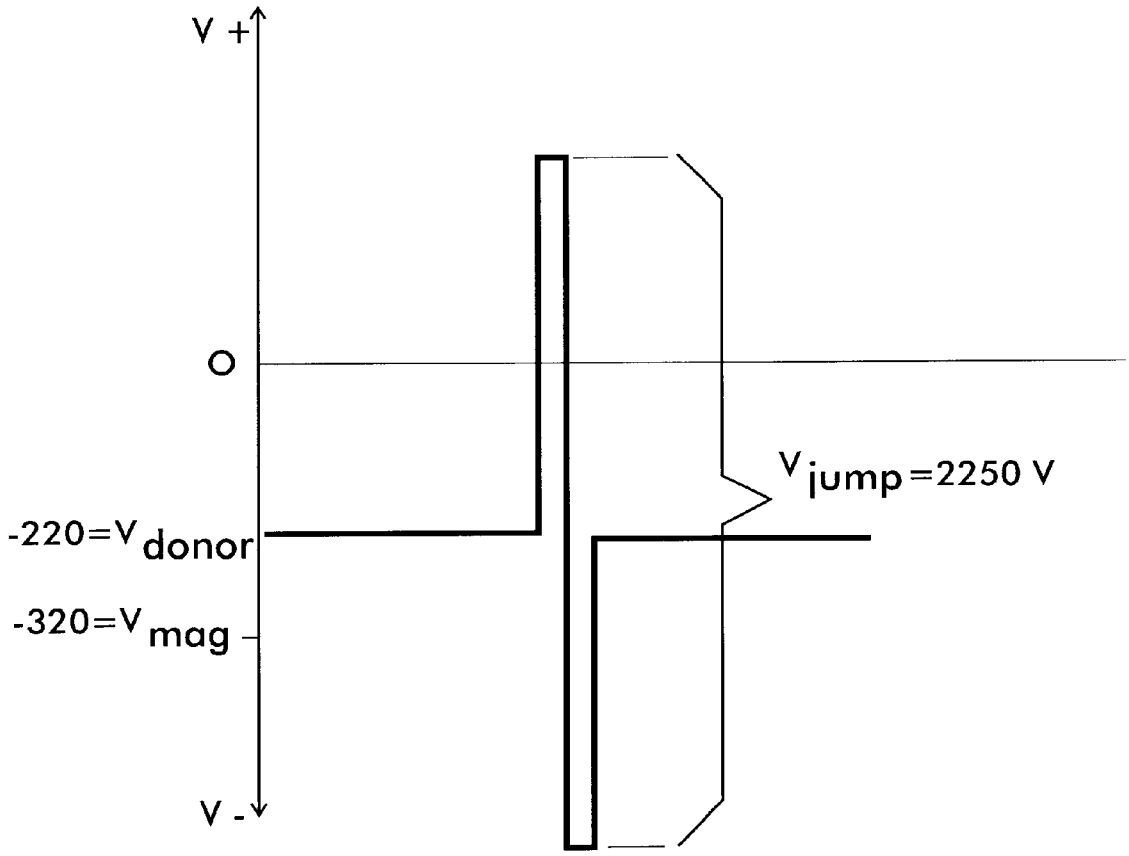

FIG. 5 is a diagram showing the relative biases on magnetic roll 38 and donor roll 36 for a typical practical embodiment of a xerographic printer. This practical embodiment will further be discussed with specific reference to the claimed invention, but of course the basic principles shown and claimed herein will apply to any applicable machine design. In this embodiment, for normal operation, the DC bias on the donor roll 36, Vdonor, is −220 VDC. Riding on this DC bias on the donor roll 36 is an AC square wave with an amplitude (top to bottom), Vjump, of 225OV: clearly, a portion of the total bias on donor roll 36 will enter positive polarity, as shown. (A typical frequency of the square wave is about 3.25 kHz.) Magnetic roll 38, under normal conditions, is biased to −113 VDC, shown as Vmag.

With the particular design of a development system such as shown in FIG. 2, a high risk location for arcing is the gap G between donor roll 36 and the surface of photoreceptor 10. Clearly, the biases Vdonor and Vjump on donor roll 36 will directly affect whether dangerous arcing conditions exist in the gap at any particular time. The function of densitometer 54, influencing control system 29, which in turn controls, among other parameters, Vdonor and Vjump, can cause the general control system, designed to optimize overall print quality, to lead to possible arcing conditions in the course of operation of the printing machine.

In order to determine whether possible arcing conditions exist in gap G, the relevant equations for field strength E for both solid (i.e., printed small areas) and background (undeveloped or white small areas) portions of an image are as follows:

$$Esolid=(Vjump/2+Vdonor)-Vimg\ gap$$

$$Ebkg=(Vjump/2-Vdonor)+Vddp\ gap$$

Where:

Vjump is the amplitude (top to bottom) of the AC potential on the donor roll 36;

Vdonor is the DC bias on donor roll 36;

Vgrid (explained below) is the potential on the corotron 20, which places the initial charge on photoreceptor 10;

gap is the width of the gap between the donor roll 36 and photoreceptor 10;

Vimg is the local potential for a small area on the photoreceptor which is intended to be developed with toner (i.e., a "solid area"); and Vddp ("dark decay potential") is the local potential for a small area on the photoreceptor which is intended to remain white in the printed image (i.e., a "background area"). Vddp can be reasonably estimated as Vddp=Vgrid+60 (or some other constant determined from real world voltage measurements of a particular printer design). Similarly, Vimg can be reasonably estimated from off-line tests of a particular printer design.

(Graphic representations of some of the above parameters can be seen in FIG. 5.)

It will be noted, in the above equations, that of the various variables, only Vjump, Vdonor, and Vgrid are readily adjustable in the course of operation of a machine, the other variables being substantially constant while the machine is running. Therefore, in order to avoid arcing conditions, the values of Esolid and Ebkg must be constrained so as not to exceed arcing conditions, and the only practical way to constrain these values is to monitor and control at least one of Vdonor, Vjump, and Vgrid while the machine is in operation.

Another important parameter affecting whether arcing conditions exist in a particular situation is the ambient air pressure, which in turn generally relates to the elevation of a particular machine relative to sea level. Once again, in general, the higher the elevation of a particular machine, the higher the likelihood of arcing conditions. Thus, according to one aspect of the present invention, an input parameter to enable the control system. A number symbolic of the elevation of the particular machine can be inputted. There are many possible ways in which this number can be entered into a control system. One option is to include a barometer or altimeter as part of the machine itself, but this would add expense. It is simpler to have service personnel enter the number relating to the elevation when the machine is installed. The nature of this number can depend on the sophistication of the system. The service personnel could enter the more or less precise elevation of the installation site, or more simply could just enter, via a control panel, a yes-or-no indication that the elevation is above a certain threshold level, such as over 4000 feet.

FIG. 6 is a flowchart illustrating the arcing-control aspect of a control system for a xerographic printer according to the present invention. It should be understood that what is shown in the figure is only a part of a general control method for maintaining print quality. As such, the arcing-avoidance steps shown in the figure can be considered as "riding on" the more general control system (not shown) by which overall desired print quality is achieved. A control system with the single desired state of optimal print quality, such as determined by readings from a densitometer monitoring the developed images on photoreceptor 10, will at various times require that different elements, such as donor roll 36 or corotron 20, have particular biases. In the course of operation of the general control system, certain biases on various elements may be demanded for the sake of print quality, and these new biases may accidentally result in arcing conditions in the development gap G. It is the general function of the present invention, and in particular the steps shown in the figure, to detect conditions in which arcing is likely to occur, and then alter the function of the general control system to avoid these arcing conditions.

With particular reference to FIG. 6, at some initial time, such as at installation of the machine at a site, an altitude is entered into the system, such as shown at step 200. Once again, this altitude may be determined by an instrument associated with the machine, or entered by service personnel. The next step, shown as 202, is to convert this altitude to an associated arcing potential. In other words, there is a known empirical relationship between the elevation and the Paschen breakdown voltage. This empirical relationship can be summarized, either precisely or roughly, by a look up table which can readily be incorporated into the machine itself. In one practical embodiment of the present invention, the function describing this empirical relationship is set at a constant 155 volts/mil gap width for any latitude from sea level to 4,000 ft., with a function sloping linearly from 155 volts/mil at 4,000 ft. to 120 volts/mil at 10,000 ft. In this way, arcing conditions for a particular altitude can be looked up. It is a matter of design choice, how close to the calculated breakdown voltage the potential in a gap G will be allowed to approach. For instance, if the breakdown voltage is determined to be 155 volts/mil, a risk-averse system could be contemplated which would trigger a warning at 100 volts/mil, while in some situations 145 volts/mil would be considered acceptably far from arcing conditions. Various threshold determination arrangements will be apparent.

Once the altitude-dependent arcing conditions are determined, the field strength of the development gap G is monitored while the printing machine is running, which also means while the general control system for optimizing print quality is running. According to the present invention, on a reasonably regular basis, such as at the start of every new job, or after an interval of a predetermined number of prints, the values of Vjump and Vdonor which are at the moment being demanded by the control system (step 204) are entered into the equations described above, to determine a running value of the field strength in the gap for both solid and background areas, Esolid and Ebkg (step 206). At step 206, these running determinations of Esolid and Ebkg are compared to the altitude dependent breakdown voltage to determine whether arcing conditions are being dangerously approached (step 210). If arcing conditions are not being approached, the system simply waits for the next interval, such as the next job over the next count of a certain number of prints, to monitor Vjump and Vdonor yet again (step 212).

If, however, the current values of either Esolid and Ebkg approach a predetermined threshold level near the breakdown voltage in which arcing conditions would result, the system shown in FIG. 6 is called upon to override the general control system to avoid this dangerous condition, in particular by causing the control system to constrain, either by dynamically tuning the duty cycle.

In the particular embodiment, since the potential on the surface of the photoreceptor varies between −550 Volts and −25 Volts, the development voltage (AC and DC) is limited by both the positive and negative peaks, depending on the potential of the photoreceptor. The field between the donor roll and the surface of the photoreceptor is calculated by the following:

The maximum negative voltage on the donor roll Vtotalnegative= [−Vdac*(negative duty cycle)+Vdb−Vdm].

The maximum positive voltage on the donor roll Vtotalpositive= [Vdac*(1-negative duty cycle)+Vdb−Vdm].

Where: The voltage on the photoreceptor being hit by the ROS=Vimage; The voltage on the photoreceptor not hit by the ROS=Vddp; The negative development field E−=Vtotalnegative−Vimage; The positive development field E+=Vtotalpositive+Vddp.

Air breakdown caused by the negative development field occurs at higher voltage than air breakdown caused by the positive development field. This is due to the surface charge of the toner on the photoreceptor. The present invention uses the center of the development waveform between the positive and negative air breakdown limits to the surface of the photoreceptor. For instance, if the process controls asks for a more negative Vdb, E− is increased, but E+ is decreased. However, by adjusting the negative duty cycle of the waveform, the change in E+ and in E− is held constant. The same would hold true for changes in Vdm, Vimage and Vddp.

FIG. 7 illustrates a typical HJD system with 50% duty cycle. The Paschen breakdown limit at a 10 mil gap is 176 V/mil. Due to increased latitude for arcing to a solid the limit is 187 V/mil. If the Jumping voltage increases due to low density, caused by low area coverage or low TC, or if the Paschen breakdown limit is lowered due to a higher altitude or low pressure, the machine will arc to the background of the print. However, if a 48.2% negative duty cycle is used, the waveform is "centered" about the arc limits of background and solid. The overall solid mass is increased slightly, and latitude of 100 V p-p Vjump is built into the system before Paschen breakdown will occur. (The following should be fixed on the diagram: First the Y-axis should be field and not voltage. Second, the 48.2% D/C is the negative duty cycle, it is labeled here as a positive duty cycle. Third, the bottom line (Paschen limit) is the Solid limit, not the Bkg limit).

The tuning the duty cycle (step 214). Of course, it is highly dependent on the overall nature of the control system for obtaining optimal print quality which of these parameters is most easily constrained to avoid arcing conditions while still maintaining desirable print quality. If it is apparent that print quality will suffer regardless of how much the duty cycle can be changed, it may be desirable to provide a system in which the printing apparatus is stopped and an error message is communicated to the user, such as to the user interface and/or over the internet (such as to service personnel).

Turning back to FIG. 2, an edge enhancement scavenging device 200 (EES device) is adjacent and down stream from donor 36. EES device 200 is biased with an AC and DC voltage. Preferably, the AC and DC voltage are identical to the voltages applied to Donor 36. EES device is position so that it has a 10 to 15 mil gap between EES device and the photoconductive member. Preferably, EES device is a conductive roll or bar having the substantial same length of donor 200 and having a radius or width of 25 mm to 100 mm.

Applicants have found that in a printing machine having the capability of printing 130 copies per minute require more development potential for making the dark solids. A developer unit having a single roll can develop dark solids in a fast machine if the role is rotated very fast compared to the photoconductive member (above 1.6 donor/PR speed ratio). The faster the donor roll rotates the more toner is developed and the worse the edge enhancement and erosion is. To eliminate this problem with edge enhancement two donor rolls have been often used in the developer unit. Applicants have found that with the use of the EES device there is no need for two donor rolls. The EES device allows a single donor roll to spin faster without edge enhancement and erosion issues at a fraction of the cost of an additional donor roll. Since the EES device does not need to move, there are no motion quality problems or uniformity issues. Applicants have also found that since the EES device scavenges toner equally through the image, it improves uniformity and banding associated with the development housing. As shown in FIG. 4, the amplitude of the voltage on the device determines how much jumping the toner undergoes. If the voltage is too high, the erosion and enhancement will return, but on the opposite edge of the image. The voltage of the device can be tuned to the donor roll speed used in the housing.

With a machine speed of 130/ppm and a donor roll speed of 400 rpm in the with direction, without an EES, the LE enhancement and TE erosion was severe. With a stationary EES device at the same voltages as the donor roll (2.4 kV, 250 Donor DC, 65 Vdm, 3.25 kHz, 11.5 mil gap) the enhancement, erosion and macro-uniformity banding was reduced. With tuning of the gaps and voltages the erosion and enhancement was eliminated. It is, therefore, apparent that there has been provided in accordance with the present invention, a hybrid jumping development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for developing a latent electrostatic image on a charge retentive surface moving in a process direction with toner, said apparatus comprising:

a supply of toner;

a donor structure spaced from said charge retentive surface for conveying toner from said supply of toner to an area adjacent said charge retentive surface, a device for applying an alternating current directly to said donor structure to create an alternating electrostatic field between said donor structure and said charge retentive surface to produce a toner cloud adjacent said charge retentive surface for developing the latent electrostatic image thereon; and an edge enhancement device, adjacent to said donor structure, for redistributing toner on the developed latent electrostatic image, said edge enhancement device includes a conductive member and a power supply for applying a bias to said edge enhancement device and;

means for adjusting said bias to said edge enhancement devices in response to a speed of said donor structure respect to speed of said charge retentive surface.

2. The apparatus of claim 1, wherein said bias on said enhancement creates an electrostatic field between said edge enhancement device and said developed latent image to scavenging toner from said developed latent image.

3. The apparatus of claim 2, wherein said edge enhancement device scavenges excess toner from a leading edge portion of said developed latent image and redistributes toner over a remaining portion of said developed latent image.

4. The apparatus of claim 2, wherein said edge enhancement device is space substantially the same distance as donor from said charge retentive surface.

5. The apparatus of claim 2, wherein said edge enhancement device has a process width of 25 mm to 100 mm.

6. An apparatus for developing a latent electrostatic image on a charge retentive surface moving in a process direction with toner, said apparatus comprising:

a supply of toner;

a donor structure spaced from said charge retentive surface for conveying toner from said supply of toner to an area adjacent said charge retentive surface, a device for applying an alternating current directly to said donor structure to create an alternating electrostatic field between said donor structure and said charge retentive surface to produce a toner cloud adjacent said charge retentive surface for developing the latent electrostatic image thereon; and an edge enhancement device, adjacent to said donor structure, for redistributing toner on the developed latent electrostatic image, said edge enhancement device includes a conductive member and a power supply for applying a bias to said edge enhancement device and; said bias applied to edge enhancement device is substantial the same bias applied to said donor.

7. The apparatus of claim 6, wherein said bias on said enhancement creates an electrostatic field between said edge enhancement device and said developed latent image to scavenging toner from said developed latent image.

8. The apparatus of claim 6, wherein said edge enhancement device scavenges excess toner from a leading edge portion of said developed latent image and redistributes toner over a remaining portion of said developed latent image.

9. The apparatus of claim 6, wherein said edge enhancement device is space substantially the same distance as donor from said charge retentive surface.

10. The apparatus of claim 6, wherein said edge enhancement device has a process width of 25 mm to 100 mm.

* * * * *